US007128665B2

(12) United States Patent
Fushihara

(10) Patent No.: US 7,128,665 B2
(45) Date of Patent: Oct. 31, 2006

(54) GOLF BALL

(75) Inventor: Kazuhisa Fushihara, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 09/984,925

(22) Filed: Oct. 31, 2001

(65) Prior Publication Data

US 2002/0077199 A1 Jun. 20, 2002

(30) Foreign Application Priority Data

Oct. 31, 2000 (JP) ..... 2000-333381

(51) Int. Cl.
*A63B 37/06* (2006.01)
*A63B 37/12* (2006.01)

(52) U.S. Cl. ..... 473/367; 473/378

(58) Field of Classification Search ..... 473/351–378
See application file for complete search history.

(56) References Cited

U.S. PATENT DOCUMENTS 4,679,795 A * 7/1987 Melvin et al. ..... 473/356
4,865,326 A * 9/1989 Isaac et al. ..... 473/374
5,000,458 A * 3/1991 Proudfit ..... 473/376
5,018,742 A * 5/1991 Isaac et al. ..... 473/378
5,540,438 A * 7/1996 Horiuchi et al. ..... 473/376
5,542,680 A * 8/1996 Proudfit et al. ..... 473/378
5,789,486 A * 8/1998 Maruoka et al. ..... 473/371
5,792,008 A * 8/1998 Kakiuchi et al. ..... 473/354
5,823,890 A * 10/1998 Maruko et al. ..... 473/354
5,840,788 A * 11/1998 Lutz et al. ..... 524/95
6,022,279 A * 2/2000 Yamagishi et al. ..... 473/200
6,155,569 A * 12/2000 Horiuchi et al. ..... 273/317

FOREIGN PATENT DOCUMENTS

EP A1-0561640 3/1993
JP 5-261166 A * 10/1993
JP 2001120687 A * 5/2001

OTHER PUBLICATIONS

Callister, Jr., William D., Materials Science and Engineering: An Introduction, 4th Edition. New Yok: John Wiley & Sons, Inc. copyright 1997, pp. 488-489.*
Steitel, Steven G., "Fluorescent Pigments (Daylight)", Kirk-Othmer Encyclopedia of Chemical Technology, Copyright 1995 by John Wiley & Sons, Inc.*

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

The present invention provides a yellow-colored golf ball which can be manufactured without polluting the production line with a yellow pigment, exhibits a glossy appearance, and has superior visibility in a cloudy weather, even in a rainy weather where the golf balls become less visible. The golf ball of the invention consists of a golf ball body containing a yellow pigment and a clear paint film which is coating the surface of the golf ball body, and has the color tone which satisfies the following relation ship: $L \geqq 85.0$ and $75 \leqq b < 90$ specified by Lab color specification.

16 Claims, No Drawings

GOLF BALL

BACKGROUND OF THE INVENTION

1. Field of the Invention

The present invention relates to a yellow-colored golf ball which can be manufactured without polluting the production line with a yellow pigment, which also has good appearance, offers superior visibility in cloudy or rainy weather, and makes such surface defects (i.e., flaw; peeling of the paint film) inconspicuous which are likely to occur due to shots.

2. Description of the Related Art

Many golf balls used in a golf practice range are white. In some golf practice ranges, use of colored golf balls, for example, yellow-colored golf balls, has begun to increase recently taking notice of their striking appearances. The golf practice range is utilized day and night and many of them are designed such that golfers hit balls from a roofed and shaded space toward a brighter field. For this reason, it is desirable that the yellow-colored golf balls is bright and clearly perceptible.

Japanese unexamined patent application No. H05-261166 discloses a yellow-colored golf ball having a golf ball body containing a yellow pigment and coated with a yellow enamel paint, wherein the difference in "b" value between before and after coating the enamel paint is not larger than 15.

The yellow-colored golf ball disclosed in Japanese unexamined patent application No. H05-261166 has a slight difference in color tone between the ball body and the enamel paint film, and hence such a color tone difference becomes apparent in a flawed or peeled portion when the golf ball is flawed or the paint film is peeled due to shots. Further, as the color tone difference between the underlying body and the paint film becomes larger with time, such a flawed or peeled portion of the golf ball becomes more conspicuous.

In an attempt to overcome the above problems, the inventor of the present invention has previously filed a Japanese application for the invention which is directed to a golf ball having a golf ball body containing a yellow pigment and coated with a clear paint. This golf ball has a color tone satisfying the following relationships: $L \geqq 85.0$ and $b=90$ to 110, and hence has superior visibility.

Although the golf ball whose b value is adjusted so as to fall within the range between 90 and 110 is excellent in visibility, it requires a large amount of a yellow pigment. For this reason, the golf ball body production line, particularly the mold used therein, is likely to be polluted with the yellow pigment. This raises a problem that golf balls with a different color from yellow cannot be manufactured continuously on the same production line after the yellow-colored golf ball bodies are manufactured. It would be possible to prevent the mold from being polluted by reducing the content of the yellow pigment to decrease the b value. In this case, however, the primary object of the colored golf ball, namely to improve the visibility of the ball in cloudy or rainy weather, cannot be attained.

The present invention has been accomplished in view of the foregoing problems. It is therefore an object of the present invention to provide a golf ball which can be manufactured without polluting the production line with the yellow pigment, has a good appearance, satisfies the required visibility in cloudy weather, even in rainy weather where the golf ball becomes less visible, and makes defects such as peeling and flaws in the paint film inconspicuous, which are likely to occur due to shots.

SUMMARY OF THE INVENTION

The present invention provides a golf ball including a golf ball body containing a yellow pigment; and a clear paint film which is coating the surface of the golf ball body and contains a fluorescent brightener, wherein the golf ball has the color tone which satisfies the following relationships specified by Lab color specification in terms of L and b values: $L \geqq 85.0$ and $75 \leqq b \leqq 90$.

DETAILED DESCRIPTION OF THE PREFERRED EMBODIMENTS

The present invention will now be described in detail.

The golf ball of the present invention includes a golf ball body containing a yellow pigment; and a clear paint film which is coating the surface of the golf ball body and contains a fluorescent brightener, wherein the golf ball has the color tone which satisfies the following relationships specified by Lab color specification in terms of L and b values: $L \geqq 85.0$ and $75 \leqq b \leqq 90$.

The clear paint film used in the present invention does not substantially contain any pigment and is developed by coating a clear paint at the surface of the golf ball body to impart the golf ball body gloss and durability. Since the clear paint film is substantially colorless and transparent, the golf ball has almost the same appearance as the color tone of the golf ball body even after the golf ball body has been coated with the clear paint. Accordingly, even if the golf ball is flawed or the clear paint film is peeled off by shots, the color tone of the golf ball body appears, thus such a flaw or a peeling of the paint film does not become conspicuous.

Examples of the clear paint film used in the present invention are, without limitation, urethane resin paint film, epoxy resin paint film and acrylic resin paint film. Among them, urethane resin paint film is preferred because the urethane resin paint film has particularly high durability against deformations or impacts caused by shots. The clear paint which develops the above clear paint film has also no limitation on its type and include, for example, solvent-borne type, water-borne type or water-dispersed type resin paint. Among them, solvent-borne type resin paint is preferred because it is excellent in coating workability.

The fluorescent brightener used in the present invention is a substance which serves to enhance the whiteness, for example, whiteness of cloth, paper, or plastics, when added thereto and has a property of absorbing light in the ultraviolet region (330 to 380 nm) of the spectrum of sunlight while showing fluorescence of blue-violet light (400 to 450 nm) in the visible light range. According to the present invention, it is possible to impart the golf ball superior visibility by coating the surface of the golf ball body with the clear paint which contains the fluorescent brightener having the above properties, even if the golf ball body has low yellowness. Thus, the golf ball of the present invention is highly visible in a cloudy weather, even in a rainy weather in which golf balls become less visible.

Examples of the fluorescent brightener are stilbene derivatives, styryl derivatives of benzene and biphenyl, bis(benzazol-2-yl) derivatives, derivatives of coumarin, carbostyryl, naphthalimide and dibenzothiophene-5,5-dioxide, pyrene derivatives, and pyridotriazole. Among them, derivatives of 4,4'-diaminostilbene-2,2'-disulfonic acid, 4-methyl-7-diethylaminocoumarin, 2,5-bis(5-tert-butyl-2-benzoxazolyl)thiophene and the like are preferred.

The fluorescent brightener has no limitation on its amount to be used, and is usually added in an amount of not less than 0.01 parts, preferably not less than 0.05 parts and not more than 2 parts and not more than 0.5 parts based on 100 parts of the clear paint by mass. If the amount of the fluorescent brightener is less than 0.01 parts by mass, the resulting golf ball has lowered visibility in a cloudy or rainy weather. If the amount is more than 2 parts by mass, the effect of the fluorescent brightener becomes saturated, resulting in an economic disadvantage.

The clear paint film used in the present invention may further contain an ultraviolet absorber or a light stabilizer in addition to the fluorescent brightener. Examples of the ultraviolet absorbers are salicylic acid derivatives, benzophenones, benzotriazoles, substituted acrylonitriles, and nickel complexes. An example of the light stabilizer is a hindered amine type light stabilizer.

The clear paint containing the fluorescent brightener, and optionally the ultraviolet absorber and/or the light stabilizer is applied directly onto the surface of the golf ball body to develop the clear paint film. There is no particular limitation to the method of applying the clear paint to the golf ball body. For example, a method such as to spray a solvent-borne clear paint onto the golf ball body with a spray gun may be employed.

The clear paint film has no limitation on its thickness, and preferably has the thickness of not less than 3 μm, more preferably of not less than 5 μm, most preferably not less than 8 μm, and preferably the thickness of not more than 25 μm, more preferably not more than 20 μm, most preferably not more than 15 μm. If the thickness of the clear paint film is less than 3μm, the resulting golf ball exhibits lowered gloss or has lowered visibility in a cloudy or rainy weather, despite the fluorescent brightener added. If the thickness is more than 25 μm, the paint is likely to accumulate in a central portion of each dimple, thus the flying performance of the golf ball is lowered.

According to the present invention, the golf ball, in the state of the surface being coated with the clear paint film, has the color tone which satisfy the following relationships specified by Lab color specification in terms of L and b values: $L \geqq 85.0$ and $75 \leqq b < 90$. The "Lab color specification", as used herein, is a color specification method prescribed by JIS-Z-8701 or JIS-Z-8728. A Lab color difference measured is converted using tristimulus values X, Y and Z as follows. In the measurement, there is used a color difference meter named "CR-221" manufactured by MINOLTA CO. in which a tristimulus values direct measuring method is adopted.

$$L=116(Y/Y_N)^{1/3}-16$$

$$a=500[(X/X_N)^{1/3}-(Y/Y_N)^{1/3}]$$

$$b=200[(Y/Y_N)^{1/3}-(Z/Z_N)^{1/3}]$$

where $X_N$, $Y_N$ and $Z_N$ are tristimulus values in the XYZ coordinate system of a perfect diffuse reflection surface.

The "L" value is an index of brightness. A larger "L" value indicates a brighter color. The "a" and "b" values are indexes of hue. The color varies toward red as the "a" value is increasing, while on the other hand the color varies toward green as the "a" value is decreasing. The color varies toward yellow as the "b" value is increasing, while on the other hand the color varies toward blue as the "b" value is decreasing.

If the "L" value is less than 85.0, the color of the golf ball gives a dark and subdued impression. Thus, the present invention requires that the "L" value is not less than 85.0. Though the larger "L" value is more desirable, whiteness increases with increasing the "L" value, and hence the "L" value is preferably not more than 95, more preferably not more than 90.

In the present invention, the "b" value is not less than 75, preferably not less than 78 and not more than 90, preferably not more than 88. In order to increase the "b" value more than 90, the amount of the yellow pigment to be contained in the golf ball body must be increased, with the result that the pollution of the production line, particularly the mold used therein, is likely to occur. If it is less than 75, the golf ball body exhibits lowered yellowness, with the result that the visibility of the golf ball in a cloudy or rainy weather is unsatisfactory even if the golf ball is coated with the clear paint film containing the fluorescent brightener.

In the present invention, the "a" value is preferably within the range between −20 and +20. If the "a" value is more than the range, the color of the ball becomes reddish, whereas if it is less than the range, the color of the ball becomes greenish. In either case, the ball gives a dark or heavy impression to the golfer. The "a" value is more preferably not less than −15, most preferably not less than −10, and more preferably not more than +15, and most preferably not more than +10. For the ball appearance to exhibit a clear yellow color, it is desirable that the "a" value is minus.

Further, in the present invention, the value $(a^2+b^2)^{1/2}$ is preferably not less than 75, more preferably not less than 78 and not more than 90. The value $(a^2+b^2)^{1/2}$ is an index of vividness. If it is less than 75, the color appears to be weak, and hence the ball becomes less perceptible in a dark location, on snow, or in a cloudy, rainy or snowy weather. On the other hand, if it is more than 90, the color of the ball becomes too strong, giving a heavier impression to the golfer.

Examples of the golf ball body for use in the present invention are a one-piece golf ball body of a single construction, a multi-piece golf ball body comprising a single-layered or multi-layered core and a cover (two-piece golf ball body, three-piece golf ball body or the like), and a wound-core golf ball body comprising a core, a rubber thread layer and a cover. Among them, the one-piece golf ball body, which is used in the golf practice range, is more preferable.

In the present invention, the pigment may be contained in the golf ball body in the case of the one-piece golf ball body, or in the cover in the case of the multi-piece golf ball or the wound-core golf ball so that the resulting golf ball has the color tone which satisfies the foregoing relationships. In adjusting the yellowness of the ball, for example, there may be a case where a red pigment or an orange pigment is used in combination with the yellow pigment. Even in such a case, the pigments are used to develop a color tone which satisfy the foregoing relationships in terms of the "L", "a" and "b" values.

The pigment, for example, includes an inorganic pigment and an organic pigment. Examples of the inorganic pigments are yellow pigments such as titanium yellow ($20TiO_2$—$NiO$—$Sb_2O_3$), litharge ($PbO$), chrome yellow ($PbCrO_4$), yellow iron oxide ($FeO(OH)$), and cadmium yellow; and red pigments such as red iron oxide ($Fe_2O_3$), red lead oxide ($Pb_3O_4$), molybdenum red, and cadmium red. Examples of the organic pigment are azo pigments, phthalocyanine pigments, and perylene pigments. Among them, the azo pigment is preferably used in view of having superior heat resistance and weather-resistance. Examples of the azo pigment are pigment yellow-1, pigment yellow-12, pigment red-3, pigment red-57, and pigment orange-13. These pigments may be used either alone or as a mixture of two or more of them.

The core or the one-piece golf ball body (hereinafter referred to as "core or the like") can be obtained by vulcanizing a rubber composition comprising a base rubber, a vulcanizing agent such as peroxide, and optionally a co-crosslinking agent or the like. Examples of the base rubbers are butadiene rubber (BR), ethylene-propylene-diene terpolymer (EPDM), isoprene rubber (IR), butyl rubber (IIR), natural rubber (NR), acrylonitrile-butadiene rubber (NBR), and styrene-butadiene rubber (SBR). These rubbers may be used either alone or in combination of two or more of them. Among them, the base rubber preferably comprises the butadiene rubber as a major component. More specifically, the base rubber comprises the butadiene rubber in an amount of at least 50% by mass. Further, the butadiene rubber is preferably a high-cis-polybutadiene in which the content of cis-1,4-bonds is not less than 90%. An example of the a high-cis-polybutadiene is "High-Cis-Polybutadiene Rubber BR-11" produced by JSR.

Examples of the co-crosslinking agents are α, β-ethylenically unsaturated carboxylic acid such as (meth)acrylic acid, and/or metal salts thereof. Examples of the suitable peroxides for vulcanization are dicumyl peroxide, 1,1-bis(t-butylperoxy)3,3,5-trimethylcyclohexane.

The core or the like may further contain a typical filler such as barium sulfate, calcium carbonate or zinc oxide, a softening agent, an antioxidant, or the like. The core or the like can be obtained, for example, by mixing the base rubber, the pigment, the filler, the co-crosslinking agent and the like together by means of a roll kneader and pressure-molding the resulting mixture under the heating condition.

In the case that the golf ball body is a multi-piece or wound-core golf ball body comprising a core and a cover, it is possible to use, for example, an ionomer resin cover or a urethane resin cover as the cover. In this case, the cover can be formed by injection-molding a cover composition which contains a cover material such as an ionomer resin or a urethane resin and a pigment directly onto the core. Alternatively, the cover can be made by molding the cover composition into two half shells and then covering the core with the two half shells and subjected to the molding. As required, the golf ball surface is formed with a multiplicity of dimples and provided with a marking stamp.

EXAMPLES

The following examples illustrate the present invention, however these examples are intended to illustrate the invention and are not to be construed to limit the scope of the invention. Many variations and modifications of such examples will exist without departing from the scope of the inventions. Such variations and modifications are intended to be within the scope of the invention.

Evaluation Methods

1. Evaluation of the Appearance of the Golf Ball

According to the following evaluation criteria, a feeling test of the appearance of the yellow-colored golf balls was carried out by ten golfers in a golf practice range. A major evaluation result from ten golfers was determined as the result of each golf ball.

Evaluation Criteria

"good": a golf ball had sufficient and favorable gloss;

"fair": a golf ball was slightly lack of gloss; and

"poor": a golf ball had no gloss.

2. Visibility of the Golf Ball in a Cloudy or Rainy Weather

Practical shot test was carried out by ten golfers in both a cloudy and a rainy weather. The visibility of each golf ball during flying and on the ground where the golf ball fell was evaluated according to the following evaluation criteria. More specifically, the visibility of the golf ball during flying means the visibility of the trajectory of the flying golf ball. A major evaluation result from the golfers was determined as the result of each golf ball.

Evaluation Criteria

"good": a golf ball was visible both during flying and on the ground;

"fair": a golf ball was not visible either one of during flying and on the ground.

"poor": a golf ball was visible neither during flying nor on the ground.

3. Production Line (Mold) Pollution

Evaluation Criteria

"good": the mold used in the production line was not polluted with a yellow pigment during manufacturing golf balls; and "poor": the mold used in the production line was polluted with the yellow pigment during manufacturing the golf balls.

Manufacture of the Golf Ball

Example 1

The base rubber composition based on the formulation of table 1 was kneaded and molded at 160° C. for 30 mins. to obtain a golf ball body. The clear paint containing the fluorescent brightener in an amount shown in Table 1 was applied onto the surface of the obtained golf ball body to obtain a test golf ball.

Comparative Example 1

A golf ball body was manufactured in the same way of Example 1. A clear paint which do not contain the fluorescent brightener was applied onto the surface of the obtained golf ball body to obtain a test golf ball.

Comparative Example 2

A golf ball body was manufactured in the same way of Example 1. A golf ball body was used as a test golf ball without applying the clear paint.

Comparative Examples 3 and 4

A golf ball body was manufactured in the same way of Example 1. A clear paint containing the fluorescent brightener was applied onto the surface of the obtained golf ball body to obtain a test golf ball. In comparative Example 4, a red pigment was used in addition to the yellow pigment.

TABLE 1

| | Ex 1 | Com 1 | Com 2 | Com 3 | Com 4 |
|---|---|---|---|---|---|
| Golf ball Body composition | | | | | |
| BR-11 | 100 | 100 | 100 | 100 | 100 |
| Zinc Oxide | 23.5 | 23.5 | 23.5 | 23.5 | 23.5 |
| Methacrylic acid | 24 | 24 | 24 | 24 | 24 |
| Calcium Carbonate | 2 | 2 | 2 | 2 | 2 |
| Dicumyl peroxide | 0.6 | 0.6 | 0.6 | 0.6 | 0.6 |
| LB305 (yellow) | 0.5 | 0.5 | 0.5 | 1.11 | 0.26 |
| BXLB (red) | — | — | — | — | 0.0017 |
| Clear Paint film | | | | | |
| Clear paint | PU | PU | none | PU | PU |
| Fluorescent Brightener | + | none | none | + | + |
| Thickness (μm) | 10 | 10 | none | 10 | 10 |

Notes on table:
BR-11: high-cis polybutadiene rubber
LB305: a yellow pigment produced by SUMIKA COLOR CO.;
BXLB: a red pigment produced by RESINO COLOR CO.;
Clear paint (PU): a solvent-borne two part type polyurethane clear paint prepared by mixing a polyester polyol (base resin) and hexamethylene diisocyanate (curing agent) together so that the molar ratio OH/NCO is 1:1.05; and
Fluorescent brightener: UBITEX-OB produced by CIBA-GEIGY Co., 2,5-bis(5-tert-butyl-2-benzoxazolyl)thiophene; used in an amount of 0.2 parts based on 100 parts of the clear paint by mass, and "+" means that the clear paint contains the fluorescent brightener.

Evaluation of the Golf Ball

The test golf balls thus manufactured in the above Example and Comparative Examples were evaluated as to their appearance and visibility in both a cloudy weather and a rainy weather according to the evaluation methods described above. The results of the evaluation were shown in Table 2.

TABLE 2

| Evaluation | Ex 1 | Com 1 | Com 2 | Com 3 | Com 4 |
|---|---|---|---|---|---|
| Color tone | | | | | |
| L value | 85.2 | 85.0 | 84.9 | 86.2 | 83.0 |
| a value | −12.3 | −12.5 | −12.0 | −12.3 | −8.3 |
| b value | 80.1 | 80.3 | 79.9 | 100.9 | 71.3 |
| $(a^2 + b^2)^{1/2}$ | 81.0 | 81.3 | 80.8 | 101.7 | 71.8 |
| Product line Pollution | good | good | good | poor | good |
| Appearance | good | good | fair | good | good |
| Visibility in | | | | | |
| Cloudy weather | good | fair | poor | good | poor |
| Rainy weather | good | poor | poor | good | poor |

As seen from Table 2, the golf ball of Example 1 was manufactured without polluting the production line, particularly the mold used therein, and had superior visibility in both a cloudy and a rainy a weather.

The golf ball of Comparative Example 1, which was coated with the clear paint which does not contain the fluorescent brightener, had particularly low visibility in a rainy weather, although the appearance thereof was good. The golf ball of Comparative Example 2, which was not coated with the clear paint, was lack of gloss, and hence this golf ball had an inferior appearance. Further, the visibility of this golf ball was not improved by the fluorescent brightener, and hence had low visibility in a cloudy or rainy weather. The golf ball of Comparative Example 3, the "b" value of which was 100.9, was superior in appearance and in visibility in a rainy weather, but the mold used for manufacturing it was polluted with the yellow pigment, because the amount of the pigment contained in the golf ball body was too large. The golf ball of Comparative Example 4, the golf ball body of which was coated with the clear paint containing the fluorescent brightener, had a superior glossy appearance but had inferior visibility in both a cloudy weather and a rainy weather because the "b" value thereof was as low as 71.3, which means that the yellowness of the ball was too low.

The golf ball of the present invention exhibits a glossy appearance and can be manufactured without polluting the production line, particularly the mold used therein. Further, the golf ball has superior visibility in a cloudy weather, even in a rainy weather where the golf balls become less visible. This application is based on Japanese Patent application No. 2000-333381 filed on Oct. 31, 2000, the contents of which are hereby incorporated by reference.

What is claimed is:

1. A golf ball comprising:

a golf ball body containing a yellow pigment in an amount of 0.5 parts or more based on 100 parts of a base rubber by mass; and a clear paint film which is directly applied on the surface of the golf ball body, the clear paint film containing a fluorescent brightener and does not substantially contain any color pigment, wherein the golf ball has the color tone which satisfies the following relationships specified by Lab color specification in terms of L and b values:

$L \geqq 850$ $-20 \leqq a \leqq 20$ $75 \leqq b < 90$ and $75 \leqq (a^2+b^2)^{1/2} \leqq 90$.

2. The golf ball according to claim 1, wherein the L, a and b values further satisfy the following relationships;

$85.0 \leqq L \leqq 90$;

$78 \leqq b \leqq 88$;

$78 \leqq (a^2+b^2)^{1/2} \leqq 90$; and $-15 \leqq a \leqq 0$.

3. The golf ball according to claim 2, wherein the clear paint has a thickness of 8 to 15 μm;

the fluorescent brightener is added in an amount of 0.05 parts to 0.5 parts based on 100 parts of the clear paint by mass; and the golf ball body is an one-piece golf ball body.

4. The golf ball according to claim 3, wherein the golf ball body further contains a red pigment and/or an orange pigment.

5. The golf ball according to claim 4, wherein the yellow pigment is a pigment yellow-1 or a pigment yellow-12.

6. The golf ball according to claim 1, wherein the clear paint film has a thickness of 3 to 25 μm.

7. The golf ball according to claim 6, wherein the clear paint film has a thickness of 8 to 15 μm.

8. The golf ball according to claim 1, wherein the golf ball body is an one-piece golf ball body.

9. The golf ball according to claim 1, wherein the fluorescent brightener is added in an amount of 0.01 parts to 2 parts based on 100 parts of the clear paint by mass.

10. The golf ball according to claim 9, wherein the fluorescent brightener is added in an amount of 0.05 parts to 0.5 parts based on 100 parts of the clear paint by mass.

11. The golf ball according to claim 1, wherein the golf ball body further contains a red pigment and/or an orange pigment.

12. The golf ball according to claim 1, wherein the yellow pigment is a pigment yellow-1 or a pigment yellow-12.

13. The golf ball according to claim 1, wherein said clear paint film is selected from the group consisting of urethane resin paint film, epoxy resin paint film and acrylic resin paint film.

14. The golf ball according to claim 1, wherein said fluorescent brightener has a fluorescence of 400 to 450 nm in the visible light range.

15. The golf ball according to claim 1, wherein said fluorescent brightener is selected from the group consisting of a derivative of 4,4'-diaminostilbene-2,2'-disulfonic acid, a derivative of 4-methyl-7-diethylaminocoumarin and a derivative 2,5-bis(5-tert-butyl-2-benzoxazolyl) thiophene.

16. A golf ball comprising:

a golf ball body containing a yellow pigment in an amount of 0.5 parts or more based on 100 parts of a base rubber by mass; and a clear paint film which is directly applied on the surface of the golf ball body;

wherein said clear paint film contains a fluorescent brightener and does not substantially contain any color pigment; and wherein the golf ball has the color tone which satisfies the following relationships specified by Lab color specification in terms of L and b values:

$L \geqq 85.0$ and $75 \leqq b < 90$.

* * * * *